US009340025B2

(12) United States Patent
Hibino et al.

(10) Patent No.: US 9,340,025 B2
(45) Date of Patent: May 17, 2016

(54) METHOD FOR PRODUCING LIQUID DISCHARGE APPARATUS, LIQUID DISCHARGE APPARATUS, AND METHOD FOR FORMING LIQUID REPELLENT LAYER

(71) Applicant: Brother Kogyo Kabushiki Kaisha, Nagoya-shi, Aichi-ken (JP)

(72) Inventors: Tomoko Hibino, Inazawa (JP); Katsumi Kakamu, Kuwana (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/633,407

(22) Filed: Feb. 27, 2015

(65) Prior Publication Data

US 2015/0273828 A1 Oct. 1, 2015

(30) Foreign Application Priority Data

Mar. 31, 2014 (JP) ..... 2014-072445

(51) Int. Cl.
*B41J 2/14* (2006.01)
*B41J 2/16* (2006.01)

(52) U.S. Cl.
CPC ..... *B41J 2/1626* (2013.01); *B41J 2/14201* (2013.01); *B41J 2/14209* (2013.01); *B41J 2/14233* (2013.01); *B41J 2/161* (2013.01); *B41J 2/164* (2013.01); *B41J 2/1606* (2013.01); *B41J 2002/14362* (2013.01); *B41J 2002/14491* (2013.01)

(58) Field of Classification Search
CPC ..... B41J 2/14201; B41J 2/14233; B41J 2002/14241; B41J 2002/1425; B41J 2002/14266; B41J 2/14274; B41J 2002/14306; B41J 2/3353
See application file for complete search history.

(56) References Cited

U.S. PATENT DOCUMENTS 7,019,438 B2 * 3/2006 Takahashi ..... B41J 2/14233 310/324
2003/0156163 A1 8/2003 Watanabe et al.
2006/0290747 A1 12/2006 Shimada et al.

FOREIGN PATENT DOCUMENTS

JP 2003/110160 4/2003
JP 2010/042683 2/2010
JP 4453655 4/2010

* cited by examiner

*Primary Examiner* — Geoffrey Mruk
(74) *Attorney, Agent, or Firm* — Frommer Lawrence & Haug LLP

(57) ABSTRACT

There is provided a method for producing a liquid discharge apparatus including a piezoelectric actuator configured to apply pressure to liquid in pressure chambers formed in a channel forming substrate. The producing method includes: forming a stacked body of an ink separation layer, piezoelectric layers, a first electrode, and second electrodes on a base member having a part to be the channel formation substrate; forming a liquid repellent layer which covers the piezoelectric layers and the second electrodes from a side opposite to the ink separation layer; and forming the pressure chambers on the base member. The liquid repellent layer is formed to have residual stress generated in the liquid repellent layer in a state that the pressure chambers are formed, the residual stress having intensity which is smaller than intensity to bend parts of the piezoelectric actuator overlapping with the pressure chambers toward the pressure chambers by 200 nm.

6 Claims, 14 Drawing Sheets

METHOD FOR PRODUCING LIQUID DISCHARGE APPARATUS, LIQUID DISCHARGE APPARATUS, AND METHOD FOR FORMING LIQUID REPELLENT LAYER

CROSS REFERENCE TO RELATED APPLICATION

The present application claims priority from Japanese Patent Application No. 2014-072445, filed on Mar. 31, 2014, the disclosure of which is incorporated herein by reference in its entirety.

BACKGROUND

1. Field of the Invention

The present teaching relates to a method for producing a liquid discharge apparatus configured to discharge liquid from nozzles, the liquid discharge apparatus configured to discharge the liquid from the nozzles, and a method for forming a liquid repellent layer by which the liquid repellent layer is formed in the liquid discharge apparatus.

2. Description of the Related Art

As a liquid discharge apparatus which discharges liquid from nozzles, there is conventionally known an ink-jet recording head which discharges ink from nozzles. In this recording head, a first insulating film is formed on the upper surface of an elastic film which is disposed to cover pressure chambers and a lower electrode film is disposed on the upper surface of the elastic film formed with the first insulating film. Further, piezoelectric films are disposed on the parts, of the upper surface of the elastic film formed with the first insulating film and the lower electrode film, overlapping with the pressure chambers, and upper electrode films are formed on the upper surfaces of the piezoelectric films. Furthermore, a second insulating film is disposed to cover the upper surface of a stacked body constructed of the elastic film, the first insulating film, the lower electrode film, the piezoelectric films, and the upper electrode films. The second insulating film is made from inorganic insulation material and has low moisture permeability. This prevents the moisture from permeating the second insulating film and reaching the upper electrode films, the piezoelectric films, the lower electrode film, and the like.

The above recording head is manufactured as follows. That is, the first insulating film, the lower electrode film, each piezoelectric film, each upper electrode film, and the like are formed on a channel formation substrate for which the pressure chamber is not yet formed, and then the pressure chamber and the like are formed in the channel formation substrate. In the recording head manufactured as described above, tensile stress or stretching stress is generated in the piezoelectric film during the formation of the piezoelectric film. The tensile stress is released when the pressure chamber is formed in the channel formation substrate to cause the force which attempts to bend the elastic film and the like so that the elastic film and the like become convex toward the pressure chamber. Meanwhile, when the second insulating film and the upper electrode film are formed, the sum of stresses generated in the second insulating film and the upper electrode film is compressive stress. The compressive stress is released when the pressure chamber is formed in the channel formation substrate to cause the force which attempts to bend the elastic film and the like so that the elastic film and the like become convex toward a side opposite to the pressure chamber. Accordingly, the above recording head can obtain the effect that the force generated by releasing the compressive stress in the second insulating film and the upper electrode film prevents the elastic film and the like from bending toward the pressure chamber. This effect can increase the displacement amount of the elastic film and the like at the time of driving a piezoelectric actuator as compared with a case in which no second insulating film is provided.

SUMMARY

In the above recording head, the second insulating film is provided to prevent the moisture from arriving at the upper electrode films, the piezoelectric films, the lower electrode film, and the like. However, even the second insulating film exhibiting low moisture permeability has a possibility as follows. That is, in a case that the moisture stays or remains at the same position on the surface of the second insulating film for a long time, the moisture permeates the second insulating film to reach the upper electrode films, the piezoelectric films, the lower electrode film, and the like.

In view of the above, it is conceivable that a liquid repellent layer is formed on the upper surface of the second insulating film to prevent the moisture from staying at the same position for a long time. In a case that the liquid repellent layer is formed on the upper surface of the second insulating film, the moisture on the surface of the liquid repellent layer moves by the effect of a slight inclination and/or vibration of the surface of the liquid repellent layer. Thus, no moisture remains at the same position on the surface of the liquid repellent layer for a long time. This can reliably prevent the moisture from permeating the second insulating film and reaching the upper electrode films, the piezoelectric films, the lower electrode film, and the like.

However, in the case that the liquid repellent layer is formed on the upper surface of the second insulating film, the tensile stress is generated in the liquid repellent layer at the time of the formation of the liquid repellent layer. In a case that each pressure chamber is formed in the channel formation substrate, the tensile stress is released to generate the force which attempts to bend the elastic film and the like so that the elastic film and the like become convex toward the pressure chamber. This reduces the effect that the force generated by releasing the compressive stress of the second insulating film and the upper electrode film prevents the elastic film and the like from bending toward the pressure chamber.

Further, regarding the above recording head in which the elastic film and the like are bent to be convex toward the side opposite to the pressure chamber in a state that no liquid repellent layer is formed, the addition of the liquid repellent layer may bend the elastic film and the like so that the elastic film and the like become convex toward the pressure chamber. That is, whether the elastic film and the like are bent to be convex toward the pressure chamber or toward the side opposite to the pressure chamber may be changed depending on the presence or absence of the liquid repellent layer.

Thus, in the above cases, desired discharge characteristics of ink, which is discharged from each nozzle at the time of driving the piezoelectric actuator, can not be obtained merely by adding the liquid repellent layer to existing ink-jet heads such as a trial ink-jet head and an ink-jet head provided for a printer which has already been commercialized. Therefore, in addition to the formation of the liquid repellent layer, it is necessary to entirely change the design of the ink-jet head by, for example, changing the size of each pressure chamber and changing the thickness and/or the material of any film of the piezoelectric actuator except for the liquid repellent layer, in order to obtain the desired discharge characteristics of ink which is discharged from each nozzle at the time of driving the piezoelectric actuator.

An object of the present teaching is to provide a method for producing a liquid discharge apparatus, the liquid discharge apparatus, and a method for forming a liquid repellent layer, those of which are capable of reliably preventing moisture from reaching piezoelectric layers and electrodes and those of are capable of obtaining desired discharge characteristics of ink, which is discharged from nozzles at the time of driving a piezoelectric actuator, without changing the design of existing liquid discharge apparatuses.

According to a first aspect of the present teaching, there is provided a method for producing a liquid discharge apparatus, the liquid discharge apparatus including:

a channel formation substrate including pressure chambers communicating with nozzles; and a piezoelectric actuator being configured to apply pressure to liquid in the pressure chambers and including an ink separation layer, piezoelectric layers, a first electrode, and second electrodes, the ink separation layer being disposed on the channel formation substrate to cover the pressure chambers therewith, the piezoelectric layers being disposed on a surface, of the ink separation layer, on a side opposite to the channel formation substrate to overlap with the pressure chambers, the first electrode being sandwiched between the ink separation layer and the piezoelectric layers to overlap with the pressure chambers, the second electrodes being disposed on surfaces, of the piezoelectric layers, on a side opposite to the ink separation layer to overlap with the pressure chambers, the method including:

forming a stacked body of the ink separation layer, the piezoelectric layers, the first electrode, and the second electrodes on a base member having a part to be the channel formation substrate;

forming a liquid repellent layer which covers the piezoelectric layers and the second electrodes from the side opposite to the ink separation layer; and forming the pressure chambers on the base member, wherein the liquid repellent layer is formed to have residual stress generated in the liquid repellent layer in a state that the pressure chambers are formed, the residual stress having intensity which is smaller than intensity to bend parts of the piezoelectric actuator overlapping with the pressure chambers toward the pressure chambers by 200 nm.

According to a second aspect of the present teaching, there is provided a method for producing a liquid discharge apparatus, the liquid discharge apparatus including:

a channel formation substrate including pressure chambers communicating with nozzles; and a piezoelectric actuator being configured to apply pressure to liquid in the pressure chambers; and including an ink separation layer, piezoelectric layers, a first electrode, and second electrodes, the ink separation layer being disposed on the channel formation substrate to cover the pressure chambers therewith, the piezoelectric layers being disposed on a surface, of the ink separation layer, on a side opposite to the channel formation substrate to overlap with the pressure chambers, the first electrode being sandwiched between the ink separation layer and the piezoelectric layers to overlap with the pressure chambers, the second electrodes being disposed on surfaces, of the piezoelectric layers, on a side opposite to the ink separation layer to overlap with the pressure chambers, wherein parts, of the piezoelectric actuator, overlapping with the pressure chambers are bent to be convex toward a side opposite to the pressure chambers, the method including:

forming a stacked body of the ink separation layer, the piezoelectric layers, the first electrode, and the second electrodes on a base member having a part to be the channel formation substrate;

forming a liquid repellent layer which covers the piezoelectric layers and the second electrodes from the side opposite to the ink separation layer; and forming the pressure chambers on the base member, wherein the stacked body is formed such that each of the piezoelectric layers has a thickness of 1 μm or more; and the liquid repellent layer is formed of organic material to have a thickness of less than 10 nm.

According to a third aspect of the present teaching, there is provided a liquid discharge apparatus configured to discharge liquid, the apparatus including:

a channel formation substrate including pressure chambers communicating with nozzles;

a piezoelectric actuator being configured to apply pressure to the liquid in the pressure chambers; and including an ink separation layer, piezoelectric layers, a first electrode, and second electrodes, the ink separation layer being disposed on the channel formation substrate to cover the pressure chambers therewith, the piezoelectric layers being disposed on a surface, of the ink separation layer, on a side opposite to the channel formation substrate to overlap with the pressure chambers, the first electrode being sandwiched between the ink separation layer and the piezoelectric layers to overlap with the pressure chambers, the second electrodes being disposed on surfaces, of the piezoelectric layers, on a side opposite to the ink separation layer to overlap with the pressure chambers; and a liquid repellent layer which covers the piezoelectric layers and the second electrodes from the side opposite to the ink separation layer, wherein parts, of the piezoelectric actuator, overlapping with the pressure chambers are bent to be convex toward a side opposite to the pressure chambers; and parts, of the liquid repellent layer and the piezoelectric actuator having the piezoelectric layers and the second electrodes covered with the liquid repellent layer, overlapping with the pressure chambers are bent to be convex toward the side opposite to the pressure chambers.

According to a fourth aspect of the present teaching, there is provided a liquid discharge apparatus configured to discharge liquid, the apparatus including:

a channel formation substrate including pressure chambers communicating with nozzles;

a piezoelectric actuator being configured to apply pressure to the liquid in the pressure chambers; and including an ink separation layer, piezoelectric layers, a first electrode, and second electrodes, the ink separation layer being disposed on the channel formation substrate to cover the pressure chambers therewith, the piezoelectric layers being disposed on a surface, of the ink separation layer, on a side opposite to the channel formation substrate to overlap with the pressure chambers, the first electrode being sandwiched between the ink separation layer and the piezoelectric layers to overlap with the pressure chambers, the second electrodes being disposed on surfaces, of the piezoelectric layers, on a side opposite to the ink separation layer to overlap with the pressure chambers; and a liquid repellent layer which covers the piezoelectric layers and the second electrodes from the side opposite to the ink separation layer, wherein parts, of the piezoelectric actuator, overlapping with the pressure chambers are bent to be convex toward a side opposite to the pressure chambers;

a thickness of each of the piezoelectric layers is 1 μm or more; and the liquid repellent layer is made of organic material to have a thickness of less than 10 nm.

According to a fifth aspect of the present teaching, there is provided a method for forming a liquid repellent layer in a liquid discharge apparatus, the liquid discharge apparatus including:

a channel formation substrate including pressure chambers communicating with nozzles; and a piezoelectric actuator configured to apply pressure to a liquid in the pressure chambers, the method including forming the liquid repellent layer to have residual stress generated in the liquid repellent layer in a state that the pressure chambers are formed, the residual stress having intensity which is smaller than intensity to bend parts of the piezoelectric actuator overlapping with the pressure chambers toward the pressure chambers by 200 nm.

According to a sixth aspect of the present teaching, there is provided a method for forming a liquid repellent layer in a liquid discharge apparatus, the liquid discharge apparatus including:

a channel formation substrate including pressure chambers communicating with nozzles; and a piezoelectric actuator being configured to apply pressure to a liquid in the pressure chambers and including piezoelectric layers each having a thickness of 1 μm or more, the method including forming the liquid repellent layer to have a thickness of less than 10 nm.

According to the present teaching, the moisture adhering to the liquid repellent layer moves by the effect of a slight inclination of the liquid repellent layer and/or a slight vibration of the liquid discharge apparatus, and thus the moisture fails to remain at the same position for a long time. This can reliably prevent the moisture adhering to the liquid repellent layer from permeating the liquid repellent layer and reaching the piezoelectric layers and the first and second electrodes. Further, it is possible to reduce as much as possible the change of bending amount of a part, of the piezoelectric actuator, overlapping with each of the pressure chambers which would be otherwise caused by the formation of the liquid repellent layer. Thus, the liquid discharge apparatus which can reliably prevent the moisture from reaching the piezoelectric layers and the first and second electrodes can be obtained merely by adding the liquid repellent layer to existing liquid discharge apparatuses without any design change of the existing liquid discharge apparatuses.

DESCRIPTION OF THE EMBODIMENTS

Hereinbelow, an embodiment of the present teaching will be explained.

Figure 1:
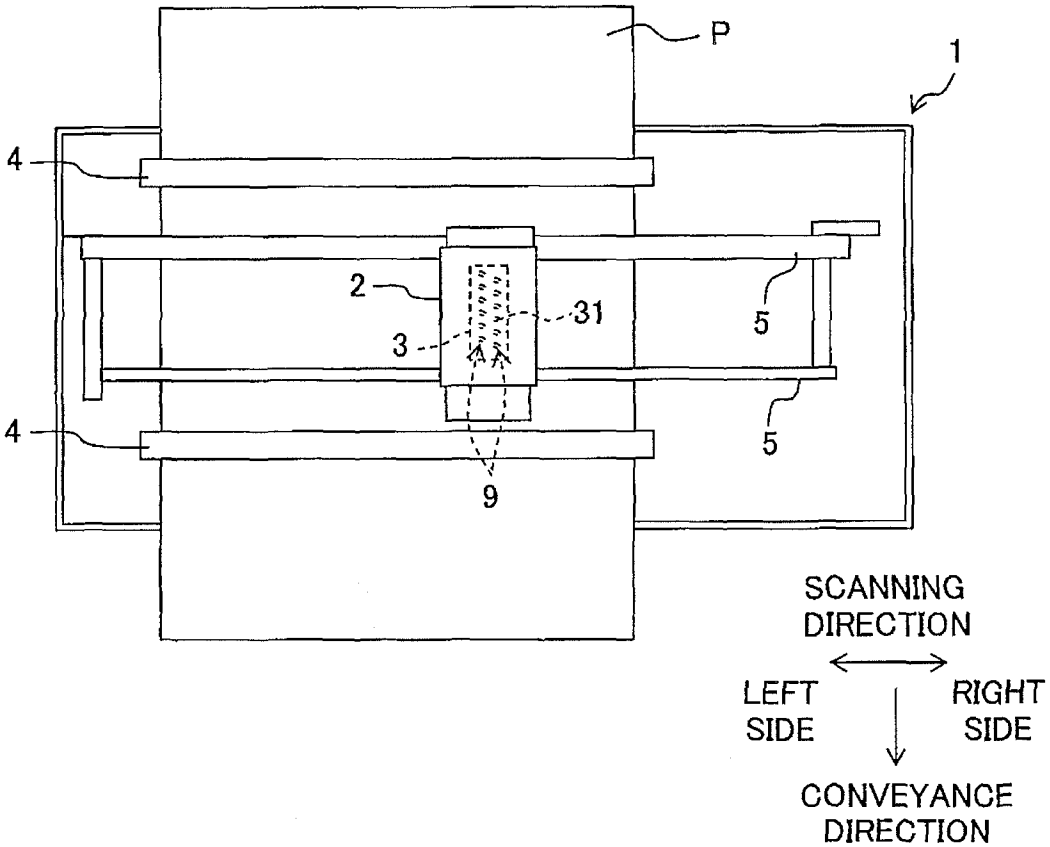
FIG. 1 is a schematic configuration diagram of a printer according to an embodiment of the present teaching.

As depicted in FIG. 1, a printer 1 according to this embodiment includes a carriage 2, an ink-jet head 3, conveyance rollers 4, and the like.

The carriage 2 is supported by two guide rails 5 extending in a scanning direction to reciprocate along the guide rails 5 in the scanning direction. The following explanation will be made with the right side and the left side of the scanning direction defined as depicted in FIG. 1. The ink-jet head 3 is carried on the carriage 2 to discharge ink from nozzles 31 formed on the lower surface of the ink-jet head 3. The conveyance rollers 4 are disposed on both sides of the carriage 2 in a conveyance direction orthogonal to the scanning direction, and convey a recording sheet P in the conveyance direction.

In the printer 1, printing is performed on the recording sheet P by discharging the ink from the ink-jet head 3 moving together with the carriage 2 in the scanning direction while conveying the recording sheet P by the conveyance rollers 4 in the conveyance direction.

Figure 2:
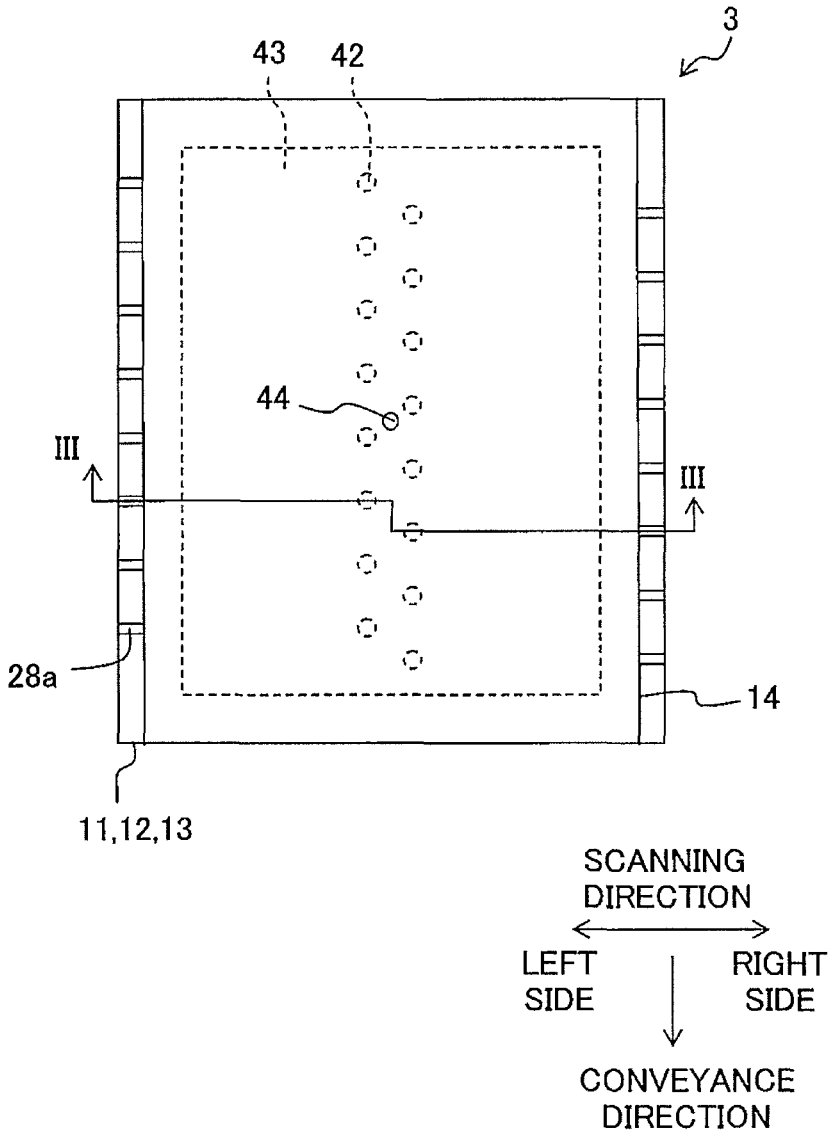
FIG. 2 is a plan view of an ink-jet head depicted in FIG. 1.
Figure 3:
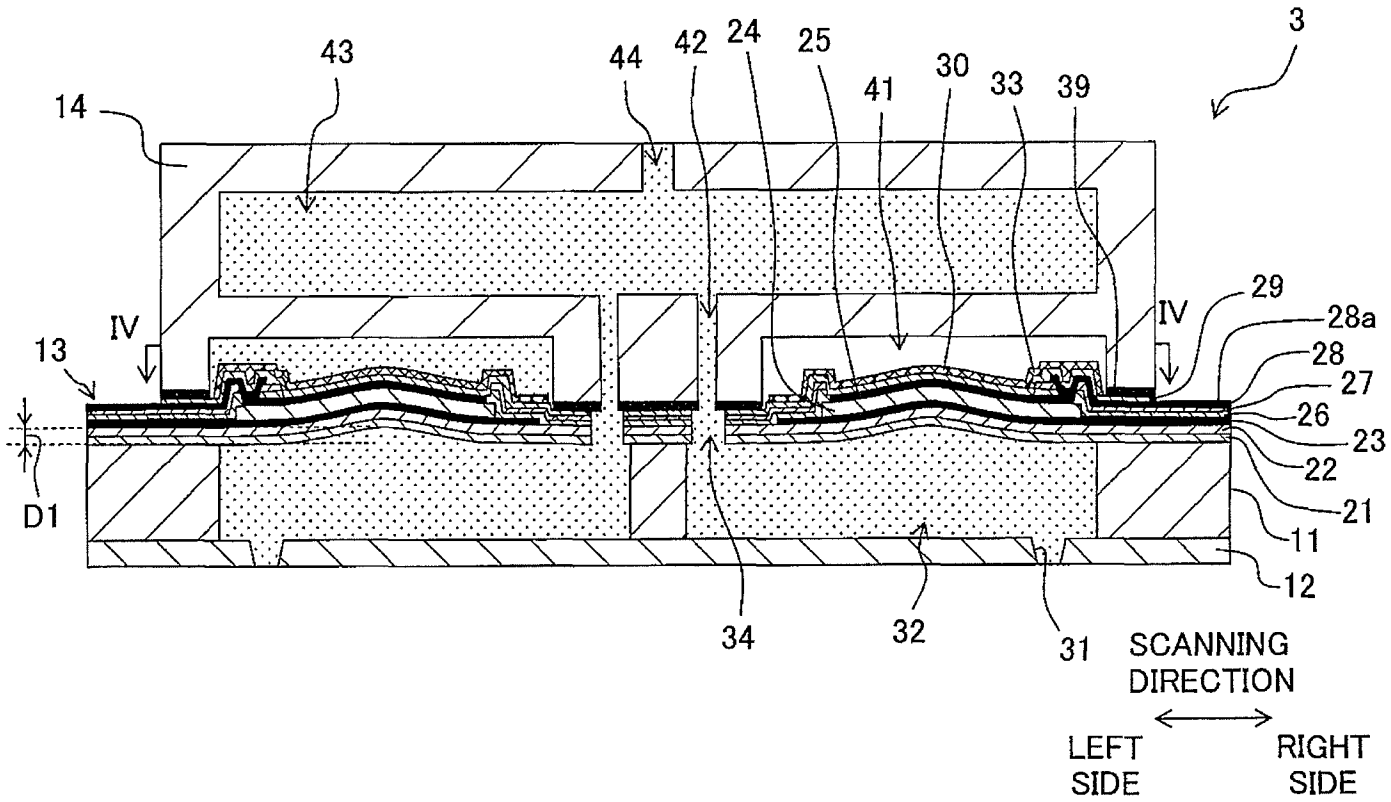
FIG. 3 is a cross-sectional view taken along the line III-III in FIG. 2.
Figure 4:
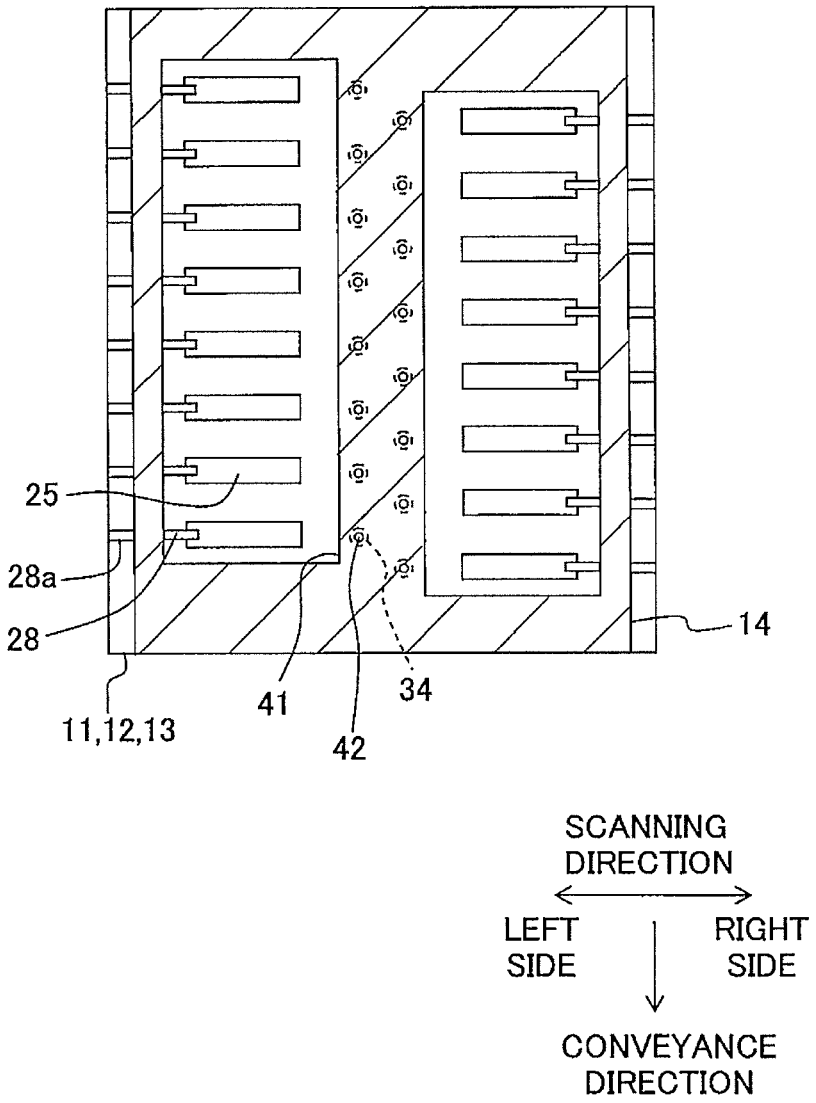
FIG. 4 is a cross-sectional view taken along the line IV-IV in FIG. 3.
Figure 5:
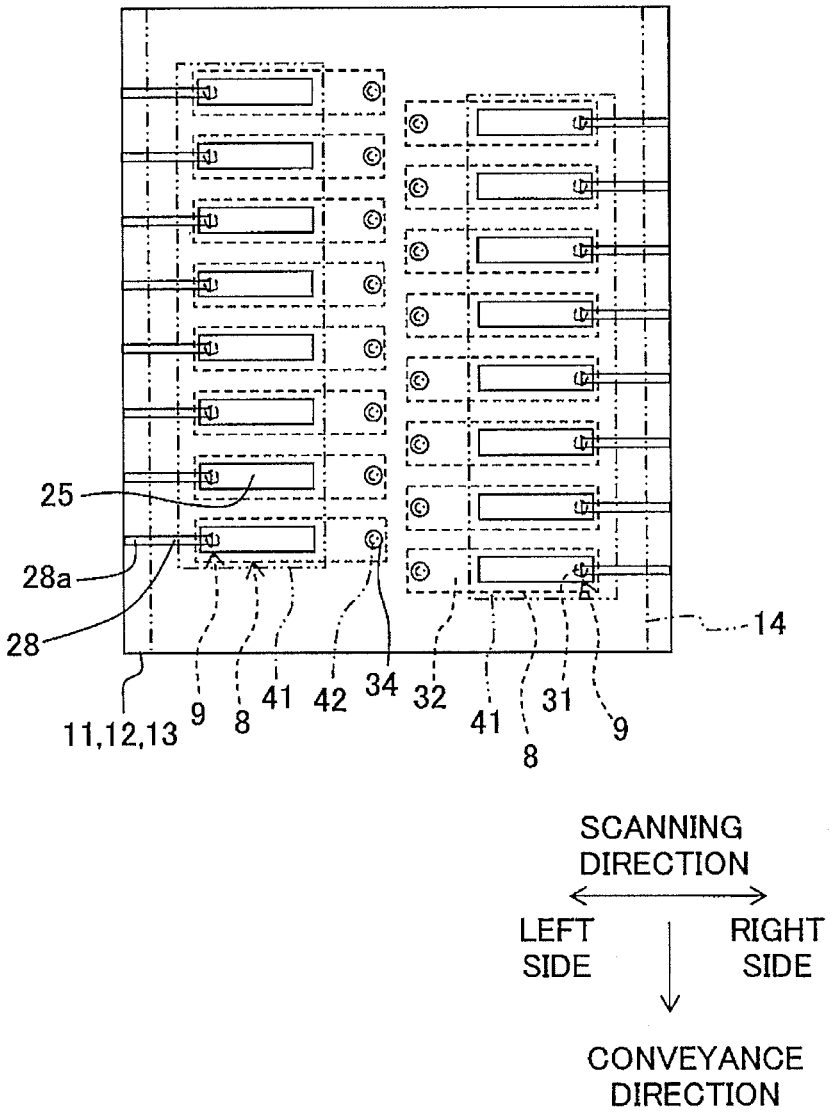
FIG. 5 is a diagram corresponding to FIG. 4 from which a protective member is removed.

Subsequently, the ink-jet head 3 will be explained. As depicted in FIGS. 2 to 5, the ink-jet head 3 is provided with a nozzle plate 12, a channel formation substrate 11, a piezoelectric actuator 13, and a protective member 14. FIG. 2 only depicts an ink storage chamber 43 and throttle channels 42 among channels formed in the ink-jet head 3. FIG. 3 depicts a thin layer to be thicker than the actual thickness. FIG. 4 depicts connection channels 34 only which will be described later among the channels formed in the ink-jet head 3. In FIG. 5, the outline of the protective member 14, the throttle channels 42, and recesses 41, are depicted by two-dot chain lines for making it easy to figure out positional relationship.

The nozzle plate 12 is made of a synthetic resin material such as polyimide. The nozzle plate 12 is formed with the nozzles 31. The nozzles 31 are aligned in the conveyance direction to form nozzle rows 9. Two nozzle rows 9 positioned to be parallel to each other in the scanning direction are formed in the nozzle plated 12.

The channel formation substrate 11 is a substrate made of silicon and is disposed on the upper surface of the nozzle plate 12. Pressure chambers 32 corresponding to the nozzles 31 are formed in the channel formation substrate 11. Each of the pressure chambers 32 has such a planar shape as an approximate rectangle elongated in the scanning direction. The pressure chambers 32 are aligned in the conveyance direction to correspond to the two nozzle rows 9, thereby forming two pressure chamber rows 8. The nozzles 31 forming the nozzle row 9 on the right side overlap with the right ends of the pressure chambers 32 forming the pressure chamber row 8 on the right side, respectively, in planar view (see FIG. 5). The nozzles 31 forming the nozzle row 9 on the left side overlap with the left ends of the pressure chambers 32 forming the pressure chamber row 8 on the left side, respectively, in planar view (see FIG. 5).

In this embodiment, since each of the pressure chambers 32 has the elongated shape in the scanning direction, it is possible to arrange, at high density in the conveyance direction, the pressure chambers 32 and the nozzles 31 communicating with the pressure chambers 32, as compared with such a case that each of the pressure chambers 32 has a square shape in planar view.

The piezoelectric actuator 13 is provided with an ink separation layer 21, a lower protective layer 22, a common electrode 23, piezoelectric layers 24, individual electrodes 25, an upper protective layer 26, an insulating layer 27, wires 28, a surface protective layer 29, and a liquid repellent layer 30.

The ink separation layer 21 is formed of silicon dioxide ($SiO_2$) or the like and extends over the entire upper surface of the channel formation substrate 11. The lower protective layer 22 is formed of alumina ($Al_2O_3$), silicon nitride, etc. The lower protective layer 22 extends over the entire upper surface of the ink separation layer 21. The sum of the thickness of the ink separation layer 21 and the thickness of the lower protective layer 22 is approximately 2 μm. The lower protective layer 22 is provided to prevent the ink, which permeates into the ink separation layer 21 from each pressure chamber 32, from reaching the common electrode 23 and the like which will be described below.

The common electrode 23 is made of a metallic material such as Pt, Ir, or $IrO_2$. The common electrode 23 is formed on the upper surface of the ink separation layer 21 formed with the lower protective layer 22. The common electrode 23 continuously extends across the pressure chambers 32. The thickness of the common electrode 23 is approximately 200 nm. The common electrode 23 is constantly maintained at ground potential.

Each of the piezoelectric layers 24 is made of a piezoelectric material composed mainly of lead zirconate titanate which is a mixed crystal of lead titanate and lead zirconate. Each of the piezoelectric layers 24 is arranged on the upper surface of the ink separation layer 21 formed with the lower protective layer 22 and the common electrode 23 to overlap with one of the pressure chambers 32. The thickness of the piezoelectric layer 24 is approximately 1 μm.

Each of the individual electrodes 25 is made of a metallic material such as Pt, Ir, or $IrO_2$. Each of the individual electrodes 25 has a substantially rectangular shape elongated in the scanning direction in planer view. Each of the individual electrodes 25 is provided on the upper surface of one of the piezoelectric layers 24 to correspond thereto so that each of the individual electrodes 25 overlaps with the central part of one of the pressure chambers 32. The thickness of the individual electrode 25 is approximately 200 nm.

Each of the piezoelectric layers 24 is sandwiched between the common electrode 23 and one of the individual electrodes 25 by arranging the common electrode 23 and each of the individual electrodes 25 as described above. The part, of the piezoelectric layer 24, sandwiched between the common electrode 23 and the individual electrode 25 is polarized in a thickness direction.

The upper protective layer 26 is made of alumina ($Al_2O_3$), silicon nitride, etc. The upper protective layer 26 is formed on the parts, of the upper surface of the ink separation layer 21 formed with the lower protective layer 22, the common electrode 23, the piezoelectric layers 24, and the individual electrodes 25, which do not overlap with the central parts of the piezoelectric layers 24, so that the parts are covered with the upper protective layer 26. The thickness of the upper protective layer 26 is approximately 80 nm. The upper protective layer 26 is provided to prevent moisture such as ink from reaching the piezoelectric layers 24 and the individual electrodes 25.

The insulating layer 27 is formed of an insulating material such as silicon dioxide. The insulating layer 27 extends over the entire upper surface of the upper protective layer 26. The thickness of the insulating layer 27 is approximately 0.5 μm. The insulating layer 27 is provided to get the insulation between the common electrode 23 and the wires 28 which will be described later. Through holes 33 are formed at the parts, of the upper protective layer 26 and the insulating layer 27, which overlap with the ends of the piezoelectric layers 24 positioned above the nozzles 31.

The reason why the upper protective layer 26 and the insulating layer 27 are formed not to overlap with the central part of the upper surface of each piezoelectric layer 24 is as follows. That is, the deformation of the piezoelectric actuator 13 is interfered with as little as possible by the upper protective layer 26 and the insulating layer 27 at the time of driving the piezoelectric actuator 13 as will be described later.

Each of the wires 28 is formed on the upper surface of the insulating layer 27. Each of the wires 28 is provided to correspond to one of the individual electrodes 25, and each of the wires 28 is connected to the part, of the corresponding individual electrode 25, exposed through the through hole 33. Each of the wires 28 extends from the part connected with the individual electrode 25 positioned above the nozzle 31 to the end of the channel formation substrate 11 in the scanning direction. The end of the wire 28 on the side opposite to the part connected with the individual electrode 25 functions as a connecting terminal **28*a*. Each of the connecting terminals 28*a* is connected to an unillustrated driver IC via an unillustrated wiring member. By virtue of this, the driver IC can apply, to each of the individual electrodes 25**, either a predetermined driving potential or the ground potential selectively.

The surface protective layer 29 is made of SiN or the like. The surface protective layer 29 extends across the upper surface of the insulating layer 27 formed with the wires 28 and the upper surfaces of the individual electrodes 25 to cover the individual electrodes 25 and the parts, of the wires 28, except for the connecting terminals **28*a* therewith. The surface protective layer 29 is provided to prevent moisture from reaching the piezoelectric layers 24, the individual electrodes 25, and the wires 28. The thickness of the surface protective layer 29** is approximately 1 μm.

The liquid repellent layer 30 is formed on the upper surface of the surface protective layer 29. However, no liquid repellent layer 30 is formed at the parts, of the upper surface of the surface protective layer 29, positioned outside each piezoelectric layer 24 in the scanning direction and the part, of the upper surface of the surface protective layer 29, positioned between the two pressure chamber rows 8. The thickness of the liquid repellent layer 30 is approximately 2 to 3 nm. The liquid repellent layer 30 is made of a silane compound such as perfluorodecyltrichlorosilane (FDTS) or octadecyltrichlorosilane (OTS). The contact angle of liquid (water) on the surface is 140 degrees or more.

As described above, the liquid repellent layer 30 is disposed on the upper surface of the piezoelectric actuator 13 in this embodiment. Thus, even when moisture such as ink adheres to the upper surface of the liquid repellent layer 30, the moisture adhering thereto moves by the effect of a slight vibration and/or inclination of the upper surface of the liquid repellent layer 30. That is, the moisture adhering to the upper surface of the liquid repellent layer 30 fails to stay or remain at the same position of the upper surface of the liquid repellent layer 30 for a long time. Therefore, no moisture permeates the liquid repellent layer 30, the surface protective layer 29, the insulating layer 27, and the upper protective layer 26, and thus no moisture arrives at the wires 28, the individual electrodes 25, the piezoelectric layers 24, and the common electrode 23.

As described above, the liquid repellent layer 30 is made of the silane compound and the contact angle of the liquid on the surface is 140 degrees or more in this embodiment. Thus, even when the thickness of the liquid repellent layer 30 is very thin (2 to 3 nm), it is possible to reliably prevent the moisture adhering to the upper surface of the liquid repellent layer 30 from remaining at the same position of the upper surface of the liquid repellent layer 30 for a long time.

Each of the connection channels 34 penetrating the piezoelectric actuator 13 in the vertical direction is formed at the part, of the piezoelectric actuator 13, which overlaps with the end of one of the pressure chambers 32 positioned on the side opposite to the nozzle 31 in the scanning direction. The part, of the piezoelectric actuator 13, which overlaps with each of the pressure chambers 32 is bent or curved to be convex toward the side opposite to the pressure chamber 32 in a state that the common electrode 23 and the individual electrode 25 are maintained at the ground potential.

Here, an explanation will be made about a method for discharging ink from nozzles 31 by driving the piezoelectric actuator 13. In the ink-jet head 3, all of the individual electrodes 25 are previously maintained at the ground potential which is the same as that of the common electrode 23. In order to discharge the ink from a nozzle 31, the electrical potential of the individual electrode 25 corresponding to this nozzle 31 is switched from the ground potential to the driving potential. Then, the potential difference between the individual electrode 25 and the common electrode 23 generates an electric field in the thickness direction parallel to a polarization direction at the part, of the piezoelectric layer 24, sandwiched between the individual electrode 25 and the common electrode 23. This allows the sandwiched part of the piezoelectric layer 24 to contract in a planar direction, and along with this, the piezoelectric layer 24 and the ink separation layer 21 deform to be convex toward the pressure chamber 32 as a whole. By virtue of this, the volume of the pressure chamber 32 is reduced to increase the pressure of the ink in the pressure chamber 32, thereby discharging the ink from the nozzle 31 communicating with the pressure chamber 32.

The protective member 14 is a rectangular parallelepiped member made of a synthetic resin material such as epoxy resin. The protective member 14 is disposed on the upper surface of the piezoelectric actuator 13. The recesses 41 are formed at the parts, of the lower surface of the protective member 14, which overlap with the piezoelectric layers 24 respectively. The parts, of the lower surface of the protective member 14, where no recesses 41 are formed are bonded to the parts, of the upper surface of the piezoelectric actuator 13, where no liquid repellent layer 30 is formed by use of an adhesive 39.

In a case that the protective member 14 is bonded to the piezoelectric actuator 13, the piezoelectric layers 24, the individual electrodes 25, the liquid repellent layer 30, and the like are disposed in enclosed spaces formed by the recesses 41. This prevents moisture such as ink from adhering to the surface of the liquid repellent layer 30.

Each of the throttle channels 42 is formed at the part, of the protective member 14, which overlaps with the one of the connection channels 34 to extend vertically through the protective member 14. The lower end of each of the throttle channel 42 is connected to one of the connection channels 34. The ink storage chamber 43, which is positioned above the throttle channels 42 to continuously extend across the two pressure chamber rows 8, is formed in the protective member 14. Each of the throttle channels 42 has the channel resistance greater than those of the pressure chamber 32, the connection channel 34, and the like. This restricts the amount of the ink which is supplied from the ink storage chamber 43 to the connection channel 34 via the throttle channel 42.

The upper end of each of the throttle channels 42 is connected to the ink storage chamber 43. An ink supply channel 44 communicating with the ink storage chamber 43 is formed on the upper end of the protective member 14.

In the ink-jet head 3, the ink contained in an unillustrated ink cartridge or the like is supplied to the ink storage chamber 43 through the ink supply channel 44. The ink in the ink storage chamber 43 is supplied to the pressure chambers 32 and the nozzles 31 through the throttle channels 42 and the connection channels 34.

Figure 6:
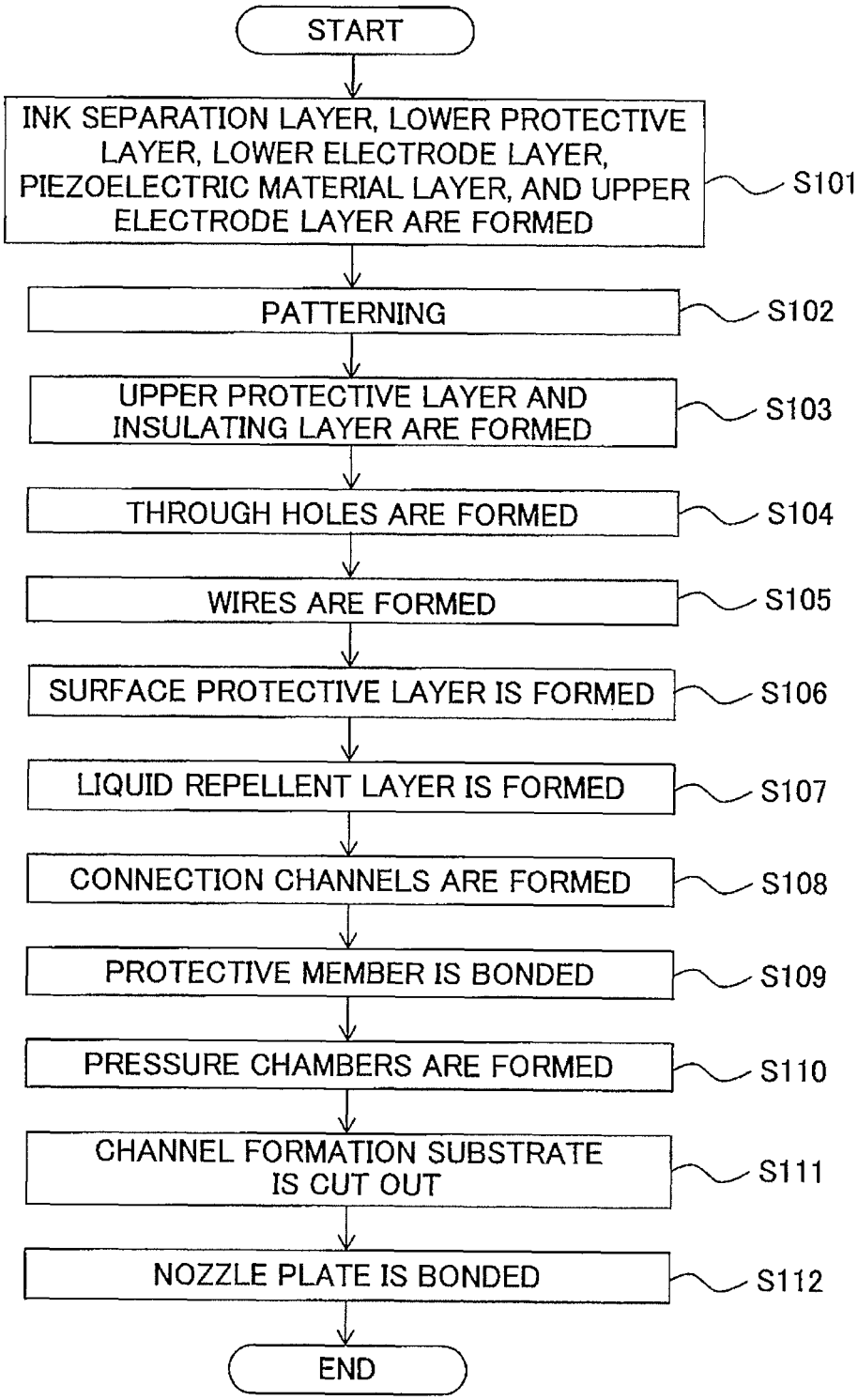
FIG. 6 is a flowchart indicating steps of producing the ink-jet head.
Figure 7:
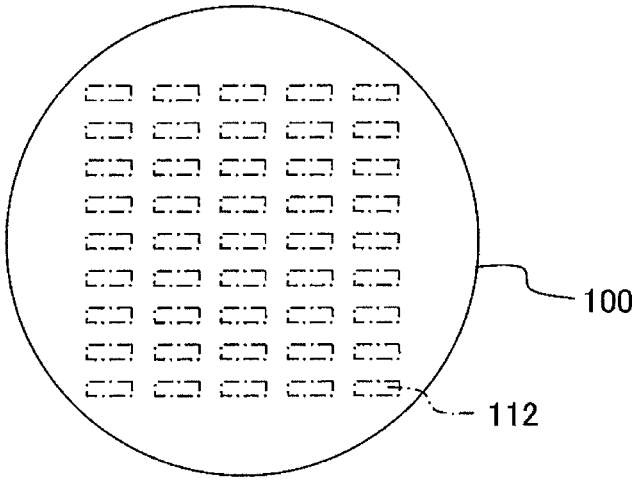
FIG. 7 is a plan view of a silicon wafer.

Subsequently, a method for manufacturing the ink-jet head 3 will be explained by using the flowchart of FIG. 6. In order to manufacture the ink-jet head 3, as depicted in FIG. 6, the ink separation layer 21, the lower protective layer 22, a lower electrode layer 123 to be the common electrode 23, a piezoelectric material layer 124 to be the piezoelectric layers 24, and an upper electrode layer 125 to be the individual electrodes 25 are formed in this order (see FIG. 8A) on the surface of a silicon wafer 100 having parts 112 to be the channel formation substrates 11 (see FIG. 7) (step S101). In the following explanation, such phrases as "step S101" will be simply expressed as "S101" and the like. In S101, the ink separation layer 21, the lower protective layer 22, and the piezoelectric material layer 124 are formed by a publicly known film formation method such as the sol-gel method or sputtering method. The lower electrode layer 123 and the upper electrode layer 125 are formed by printing or the like.

Figures 8A, 8B, 8C, 8D:
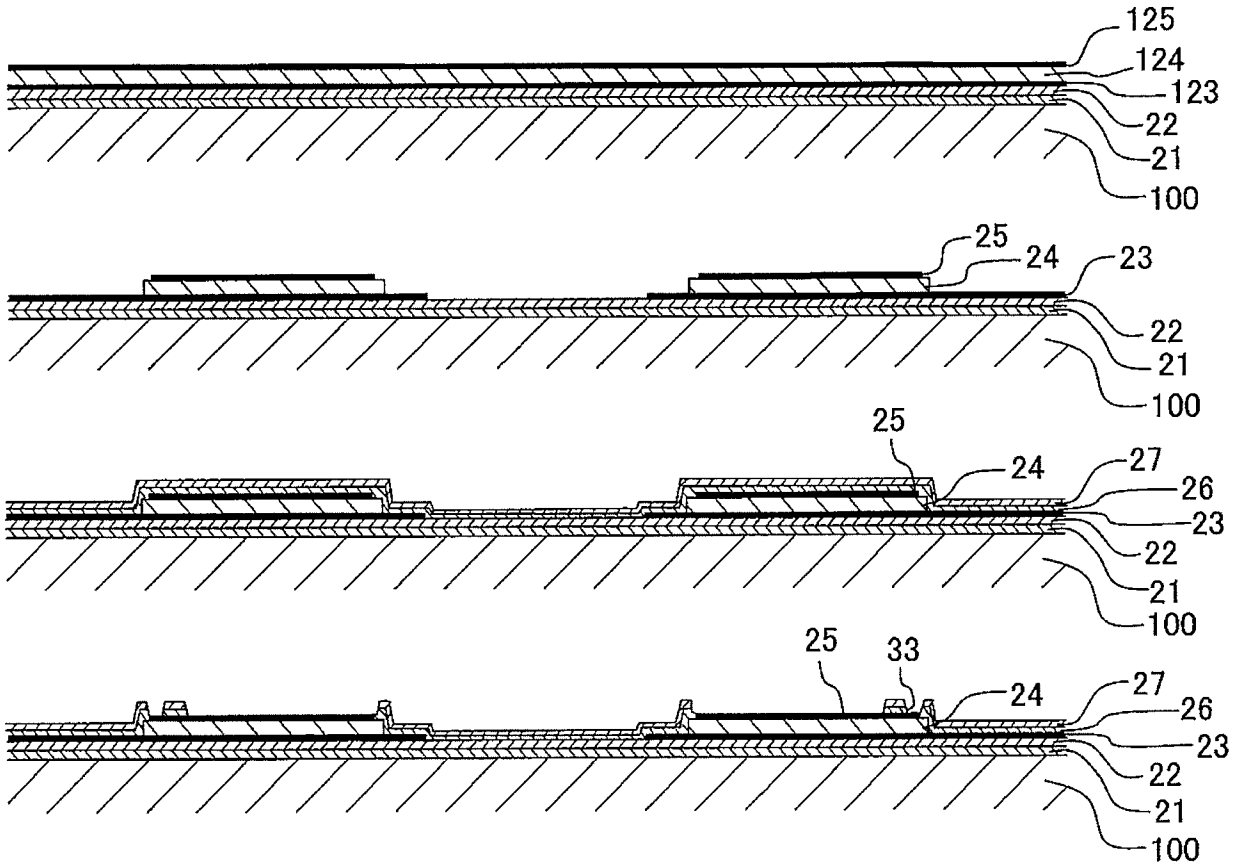
FIG. 8A depicts a step of forming an ink separation layer, a lower protective layer, a lower electrode layer, a piezoelectric material layer, and an upper electrode layer on the silicon wafer.
FIG. 8B depicts a step of performing patterning of individual electrodes, piezoelectric layers, and a common electrode.
FIG. 8C depicts a step of forming an upper protective layer and an insulating layer.
FIG. 8D depicts a step of forming through holes in the upper protective layer and the insulating layer and exposing the individual electrodes.

Subsequently, as depicted in FIG. 8B, the patterning is performed to form the individual electrodes 25, the piezoelectric layers 24, and the common electrode 23 by sequentially removing the needless parts of the upper electrode layer 125, the piezoelectric material layer 124, and the lower electrode layer 123 through etching or the like (S102).

Figures 9A, 9B, 9C, 9D:
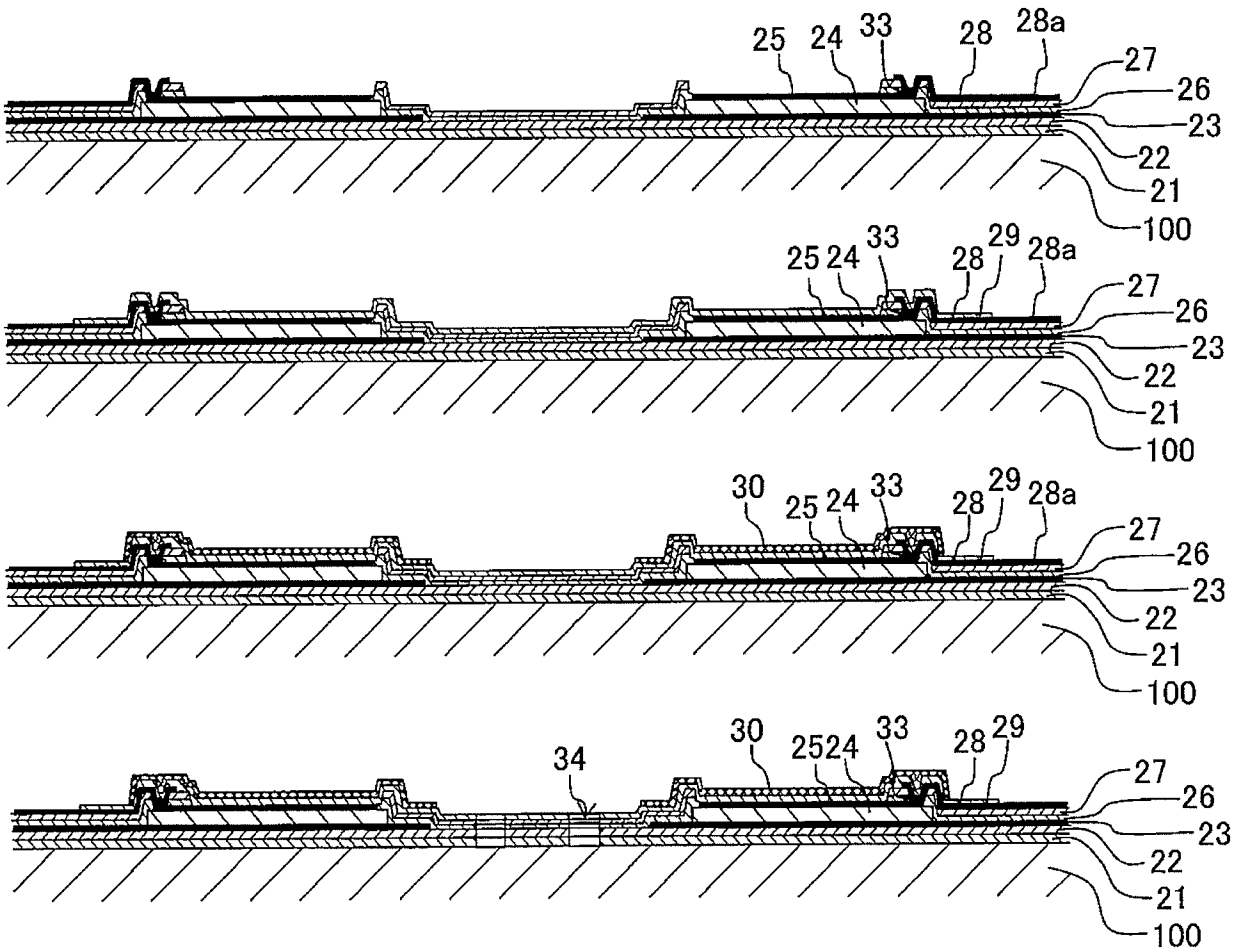
FIG. 9A depicts a step of forming wires.
FIG. 9B depicts a step of forming a surface protective layer.
FIG. 9C depicts a step of forming a liquid repellent layer.
FIG. 9D depicts a step of forming connection channels.

Subsequently, as depicted in FIG. 8C, the upper protective layer 26 and the insulating layer 27 are sequentially formed by the publicly known film formation method (S103). Then, as depicted in FIG. 8D, the parts, of the upper protective layer 26 and the insulating layer 27, which overlap with the central parts of the piezoelectric layers 24 are removed by the etching or the like and the through holes 33 are formed in the upper protective layer 26 and the insulating layer 27 (S104). Next, the wires 28 are formed by printing or the like as depicted in FIG. 9A (S105). Next, the surface protective layer 29 is formed by the publicly known film formation method as depicted in FIG. 9B (S106).

Subsequently, as depicted in FIG. 9C, the liquid repellent layer 30 is formed by depositing the molecules of the silane compound onto the upper surface of a stacked body constructed of the ink separation layer 21, the lower protective layer 22, the common electrode 23, the piezoelectric layers 24, the individual electrodes 25, the upper protective layer 26, the insulating layer 27, the wires 28, and the surface protective layer 29 (S107). In this step, before the deposition of the molecules of the silane compound, masks are disposed on the parts, of the upper surface of the stacked body, to be both ends of the channel formation substrate 11 in the scanning direction and the part, of the upper surface of the stacked body, to be positioned between the two pressure chamber rows 8, so that the liquid repellent layer 30 is formed only on the parts, of the upper surface of the stacked body, where no masks are disposed. By performing the above steps, the piezoelectric actuator 13 is formed at each of the parts 112 of the silicon wafer 100 which corresponds to one of the channel formation substrates 11.

Figure 10:
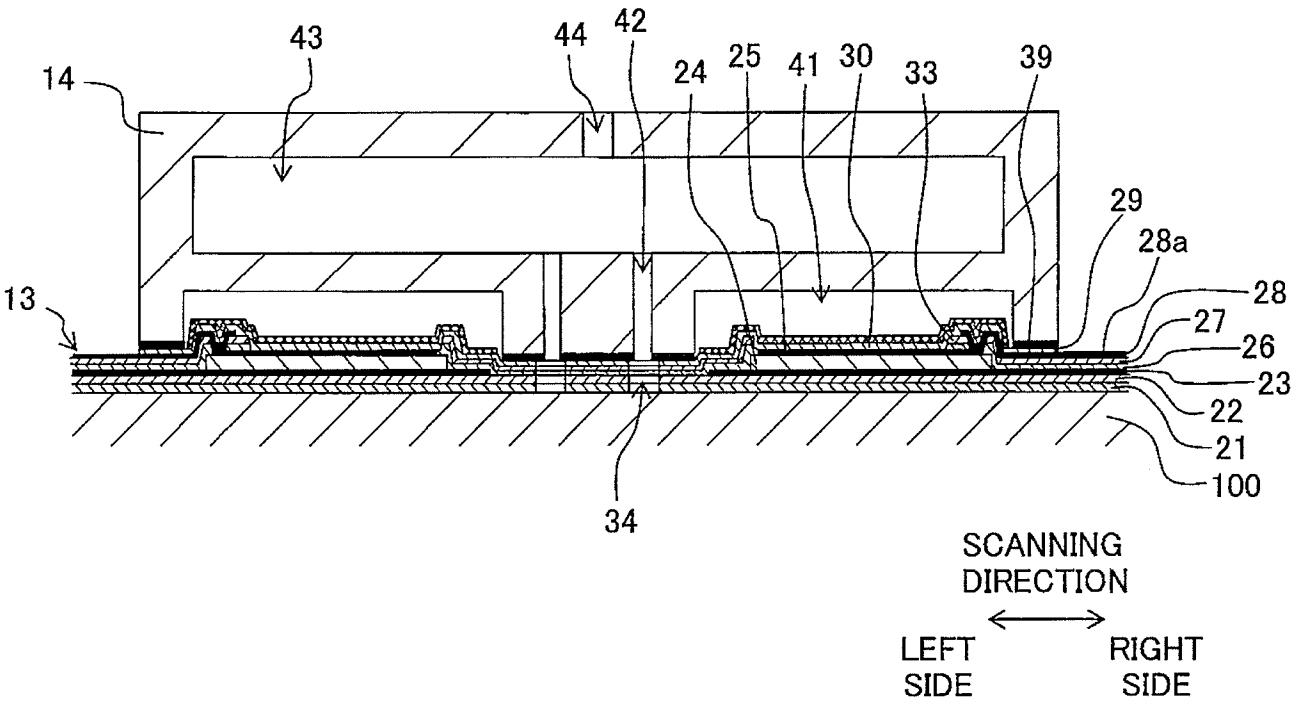
FIG. 10 depicts a step of adhesion or bonding of the protective member.

Subsequently, as depicted in FIG. 9D, the connection channels 34 are formed by the etching or the like (S108). Then, as depicted in FIG. 10, the protective member 14 manufactured separately is bonded to the upper surface of the piezoelectric actuator 13 by use of the adhesive 39.

Figure 11:
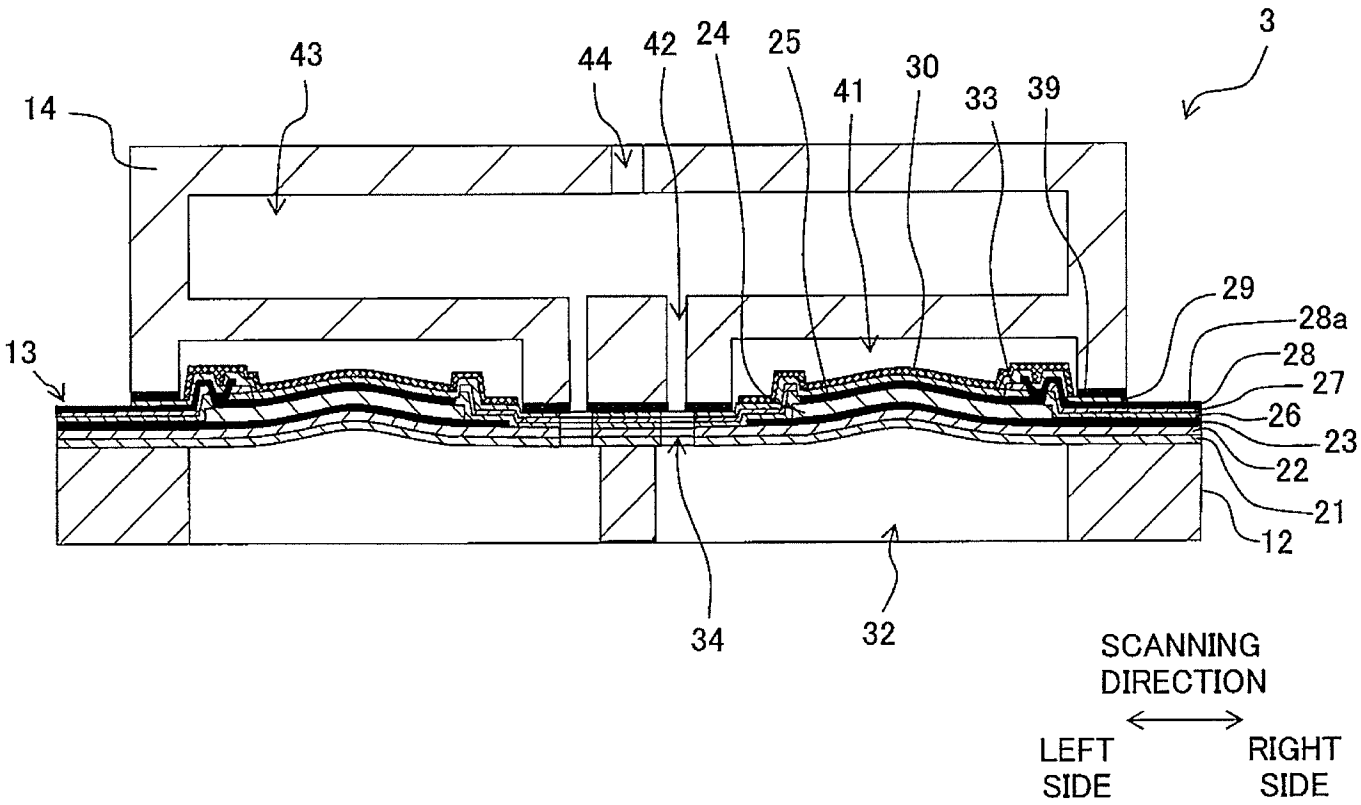
FIG. 11 depicts a step of forming pressure chambers.

Subsequently, as depicted in FIG. 11, the pressure chambers 32 are formed by the etching or the like at each of the parts 112, of the silicon wafer 100, to be one of the channel formation substrates 11 (S110). In a case that respective layers forming the piezoelectric actuator 13 are formed on the silicon wafer 100, residual stress occurs in the respective layers of the piezoelectric actuator 13 due to the difference among coefficients of thermal expansion of the silicon wafer 100 and the respective layers of the piezoelectric actuator 13. Forming each of the pressure chambers 32 releases the residual stress, which makes the part, of the piezoelectric actuator 13, overlapping with each of the pressure chambers 32 bend to be convex toward the side opposite to the pressure chamber 32.

More specifically, the sum of the residual stresses generated in the ink separation layer 21, the lower protective layer 22, the common electrode 23, and the piezoelectric layer 24 is tensile stress. Forming the pressure chamber 32 releases the tensile stress, which causes the force in a compression direction on the upper side of a neutral plane of the piezoelectric actuator 13. The force in the compression direction attempts to bend the part of the piezoelectric actuator 13 overlapping with the pressure chamber 32 so that the part becomes convex toward the pressure chamber 32. In this context, the neutral plane is a plane which neither expands nor contracts when the bending moment is applied to the piezoelectric actuator 13.

The sum of the residual stresses generated in the individual electrode 25, the upper protective layer 26, the insulating layer 27, and the surface protective layer 29 is compressive stress. Forming the pressure chamber 32 releases the compressive stress, which causes the force in a tensile direction on the upper side of the neutral plane of the piezoelectric actuator 13. The force in the tensile direction attempts to bend the part of the stacked body overlapping with the pressure chamber 32 so that the part becomes convex toward the side opposite to the pressure chamber 32.

The residual stress generated in the liquid repellent layer 30 is the tensile stress. Forming the pressure chamber 32 releases the tensile stress, which causes the force in the compression direction on the upper side of the neutral plane of the piezoelectric actuator 13. The force in the compression direction attempts to bend the part of the piezoelectric actuator 13 overlapping with the pressure chamber 32 so that the part becomes convex toward the pressure chamber 32.

In this embodiment, the force, which is generated at the time of forming the pressure chamber 32 to attempt to bend the part of the piezoelectric actuator 13 overlapping with the pressure chamber 32 so that the part becomes convex toward the side opposite to the pressure chamber 32, is greater than the force which attempts to bend the part so that the part becomes convex toward the pressure chamber 32. As a result, the part of the piezoelectric actuator 13 overlapping with the pressure chamber 32 is bent to be convex toward the side opposite to the pressure chamber 32 at the time of forming the pressure chamber 32. In other words, in this embodiment, the sum total of the residual stresses remained on the upper side of the neutral plane of the piezoelectric actuator 13 is the compressive stress. Forming the pressure chamber 32 releases this compression stress, which causes the force in the tensile direction on the upper side of the neutral plane of the piezoelectric actuator 13. As described above, the force in the tensile direction attempts to bend the part of the stacked body overlapping with the pressure chamber 32 so that the part becomes convex toward the side opposite to the pressure chamber 32.

After that, each of the channel formation substrates 11 is cut out from the silicon wafer 100 (S111), and the nozzle plate 12 manufactured separately is bonded to the lower surface of each of the channel formation substrate 11 (S112). Accordingly, the ink-jet head 3 is completed.

Figure 12:
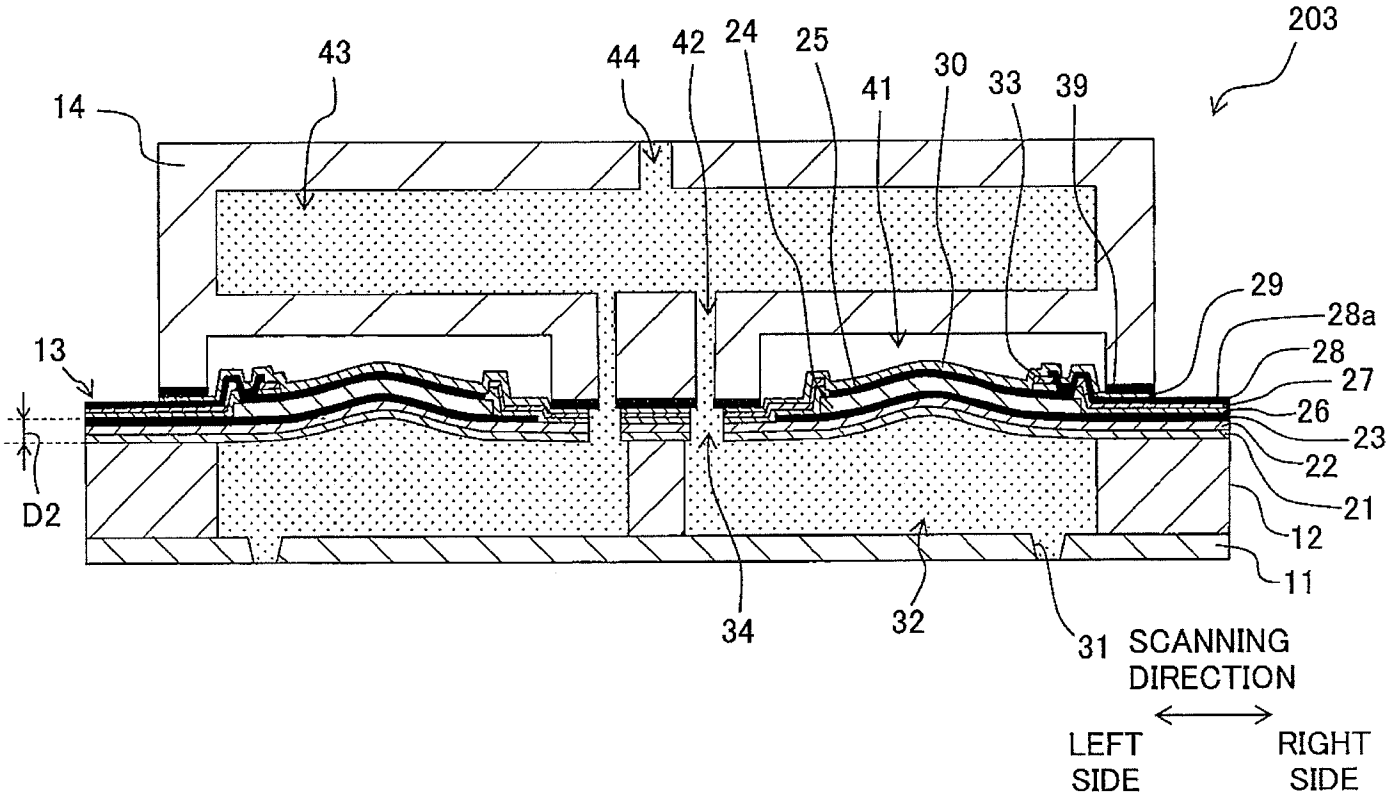
FIG. 12 is a diagram of an ink-jet head having no liquid repellent layer which corresponds to FIG. 3.

An ink-jet head 203 depicted in FIG. 12 is an ink-jet head which is obtained by removing the liquid repellent layer 30 from the ink-jet head 3 of this embodiment. The ink-jet head 203 is an exemplary existing ink-jet head such as a trial ink-jet head and an ink-jet head provided for a printer which has already been commercialized. In a case that the ink-jet head 203 is manufactured, as depicted in FIG. 9B, after the formation of the surface protective layer 29, the formation of the connection channels 34, the bonding of the protective member 14, and the formation of the pressure chambers 32 are performed without forming the liquid repellent layer 30.

In this case, the liquid repellent layer 30 is not provided in the piezoelectric actuator 13. Thus, unlike this embodiment, the force in the compression direction due to the release of the residual stress of the liquid repellent layer 30 never occurs in the piezoelectric actuator 13. Therefore, the part of the piezoelectric actuator 13 overlapping with the pressure chamber 32 is bent to be convex toward the side opposite to the pressure chamber 32. Further, a displacement amount D2 of the part of the piezoelectric actuator 13 overlapping with the pressure chamber 32 in the ink-jet head 203 is greater than a displacement amount D1 of the part of the piezoelectric actuator 13 overlapping with the pressure chamber 32 of the ink-jet head 3 of this embodiment.

The ink-jet head 3 can be regarded as an ink-jet head obtained by adding the liquid repellent layer 30 to the ink-jet head 203. When the ink-jet head 3 is compared to the ink-jet head 203, it is understood that adding the liquid repellent layer 30 to the ink-jet head 203 makes the displacement amount D1 of the ink-jet head 3 smaller than the displacement amount D2 of the ink-jet head 203 having no liquid repellent layer 30.

Meanwhile, in a case that the thickness of the liquid repellent layer 30 is greater than that of this embodiment, the force which attempts to bend the part of the piezoelectric actuator 13 overlapping with the pressure chamber 32 so that the part becomes convex toward the pressure chamber 32 is greater than that of this embodiment. For example, unlike this embodiment, in a case that the liquid repellent layer 30 is made of inorganic material and that the liquid repellent layer 30 is formed by film formation, physical vapor deposition, or the like, the thickness of the liquid repellent layer 30 is 10 nm or more. That is, the thickness of the liquid repellent layer 30 is greater than that of this embodiment.

In such a case, the decrease in the displacement amount of the part of the piezoelectric actuator 13 overlapping with the pressure chamber 32 caused by the addition of the liquid repellent layer 30 is greater than that of this embodiment. This reduces the displacement amount of the part of the piezoelectric actuator 13 overlapping with the pressure chamber 32 at the time of applying the driving potential to the individual electrode 25.

Especially, in a case that the part of the piezoelectric actuator 13 overlapping with the pressure chamber 32 is bent to be convex toward the pressure chamber 32 due to the addition of the liquid repellent layer 30, the deformation amount of the part of the piezoelectric actuator 13 overlapping with the pressure chamber 32 at the time of driving the piezoelectric actuator 13 greatly decreases.

Thus, in such a case, the ink-jet head to which the liquid repellent layer 30 is added may be required to entirely change the design thereof by, for example, changing the size of an ink channel such as the pressure chamber 32 and changing the thickness and/or the material of a layer of the piezoelectric actuator 13 except for the liquid repellent layer 30, in order to obtain desired discharge characteristics of ink, which is discharged from the nozzles 31 at the time of driving the piezoelectric actuator 31.

In this embodiment, however, the thickness of the liquid repellent layer 30 is considerably thinner than the thickness of each of the layers constructing the piezoelectric actuator 13 (e.g. the thickness of the piezoelectric layer 24). In this embodiment, the thickness of the liquid repellent layer 30 is 2 to 3 nm, whereas the sum total of the thicknesses of respective layers constructing the piezoelectric actuator 13 is approximately 5 μm. Thus, the force caused by releasing the tensile stress generated in the liquid repellent layer 30 is smaller than the force caused by releasing the stresses generated in other layers of the piezoelectric actuator 13.

Therefore, the difference between the displacement amount D1 and the displacement amount D2 is not so large. For example, in a case that the displacement amount D2 is about 400 nm, the difference (D2–D1) in the displacement amounts caused by the formation of the liquid repellent layer 30 is less than 200 nm. Thus, the displacement amount of the part of the piezoelectric actuator 13 overlapping with the pressure chamber 32 at the time of driving the piezoelectric actuator 13 in the ink-jet head 3 is not so different from that in the ink-jet head 203. That is, even when the liquid repellent layer 30 is added to the ink-jet head 203, the deformation amount of the part of the piezoelectric actuator 13 overlapping with the piezoelectric chamber 32 at the time of driving the piezoelectric actuator 13 does not decrease greatly.

In this case, the part of the piezoelectric actuator 13 overlapping with the pressure chamber 32 is bent to be convex toward the side opposite to the pressure chamber 32 both in the existing ink-jet head 203 having no liquid repellent layer 30 and the ink-jet head 3 having the liquid repellent layer 30. That is, even when the liquid repellent layer 30 is added to the ink-jet head 203, the bending direction of the part of the piezoelectric actuator 13 overlapping with the pressure chamber 32 never changes.

As described above, the liquid repellent layer 30 can be added to the ink-jet head 203 without any design change of the ink-jet head 203, and the ink-jet head 3 having the liquid repellent layer 30 can obtain the desired discharge characteristics of ink which is discharged from the nozzles 31 at the time of driving the piezoelectric actuator 31. Accordingly, the ink-jet head 3 which is capable of reliably preventing moisture from reaching the common electrode 23, the piezoelectric layers 24, the individual electrodes 25, and the wires 28 can be obtained merely by forming the liquid repellent film 30 to the existing ink-jet head 203 without any design change of the ink-jet head 203.

In this embodiment, the liquid repellent layer 30 is provided only at the parts, of the upper surface of the piezoelectric actuator 13, to which the protective member 14 is not bonded. Thus, the adhesive 39 stays at appropriate positions when being applied to the piezoelectric actuator 13, thereby making it possible to securely bond the protective member 14 to the piezoelectric actuator 13.

In this embodiment, each pressure chamber 32 is formed in the silicon wafer 100 after the formation of the liquid repellent layer 30. Here, unlike this embodiment, it is conceivable that the liquid repellent layer 30 is formed after the formation of each pressure chamber 32. In such a case, the part of the piezoelectric actuator 13 overlapping with the pressure chamber 32 to which the liquid repellent layer 30 is not yet formed is bent to be convex toward the pressure chamber 32 at the time of forming the pressure chamber 32, and thus the liquid repellent layer 30 is required to be formed on the bent surface. Therefore, in this case, the control of thickness of the liquid repellent layer 30 and the like are complicated as compared with this embodiment.

In this embodiment, each pressure chamber 32 is formed after the formation of the liquid repellent layer 30 as described above. Thus, the liquid repellent layer 30 can be easily formed on a flat surface to have a uniform thickness.

In this embodiment, the steps of S101 to S106 correspond to forming a stacked body according to the present teaching. The step of S107 corresponds to forming a liquid repellent layer according to the present teaching. The step of S109 corresponds to bonding a protective member according to the present teaching. The step of S110 corresponds to forming pressure chambers according to the present teaching. The step of S111 corresponds to cutting out channel formation substrates according to the present teaching.

The ink-jet head 3 corresponds to a liquid discharge apparatus according to the present teaching. The common electrode 23 corresponds to a first electrode according to the present teaching. The individual electrodes 25 correspond to second electrodes according to the present teaching. The silicon wafer 100 corresponds to a base member according to the present teaching. The recesses 41 of the protective member 14 correspond to space forming portions according to the present teaching.

Subsequently, an explanation will be made about modified embodiments to which various changes or modifications are made.

<First Modified Embodiment>

Figure 13:
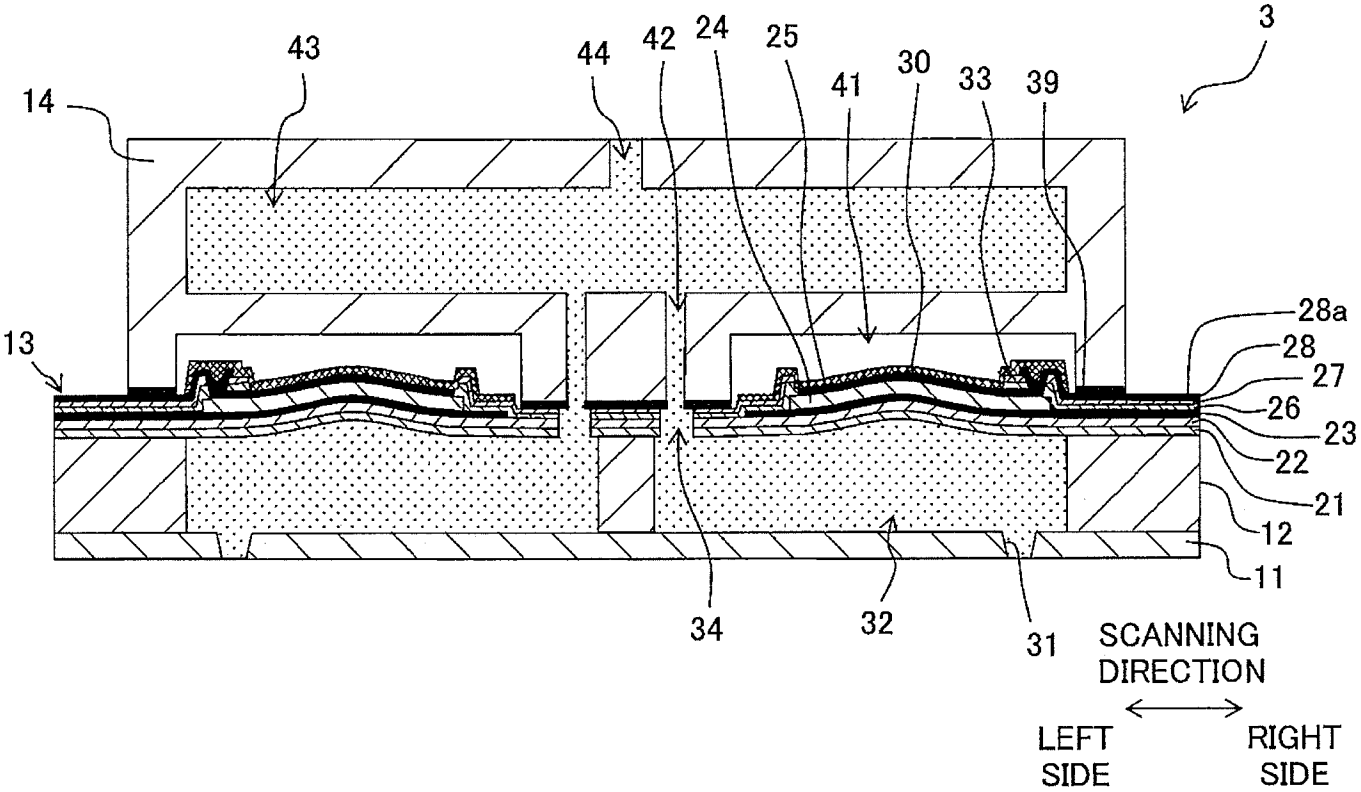
FIG. 13 is a diagram of a first modified embodiment which corresponds to FIG. 3.

In the above embodiment, the surface protective layer 29 is disposed on the lower side of the liquid repellent layer 30. The present teaching, however, is not limited to this configuration. As depicted in FIG. 13, the surface protective layer 29 is not provided on the lower side of the liquid repellent layer 30 in a first modified embodiment. In this case also, the contact angle of the upper surface of the liquid repellent layer 30 is very high (140 degrees or more). Thus, the moisture adhering to the upper surface of the liquid repellent layer 30 can not penetrate the liquid repellent layer 30 and can not arrive at the individual electrodes 25, the piezoelectric layers 24, and the common electrode 23.

In the above embodiment, the liquid repellent layer 30 is made of the silane compound. The liquid repellent layer 30 may be made of organic material other than the silane compound. In a case that the liquid repellent layer 30 is formed by depositing the molecules of the organic material, the liquid repellent layer 30 thinner than 10 nm can be formed. Further, in this case, the contact angle of the upper surface of the liquid repellent layer 30 may be 140 degrees or less provided that the contact angle is at least 90 degrees or more. Furthermore, when the thickness of the liquid repellent layer 30 can be thinner, the liquid repellent layer 30 may be made of inorganic material.

In the above embodiment, the thickness of the liquid repellent layer 30 is approximately 2 to 3 nm. The present teaching, however, is not limited to this configuration. Even when the thickness of the liquid repellent layer 30 is greater than that in the above embodiment, when the thickness of the liquid repellent layer 30 is less than 10 nm, the force, which is generated by releasing the residual stress of the liquid repellent layer 30 and attempts to bend the part of the piezoelectric actuator 13 overlapping with the pressure chamber 32 so that the part becomes convex toward the pressure chamber 32, is small. That is, the difference (D2−D1) between the displacement amount D1 and the displacement amount D2 is small. Accordingly, the part of the piezoelectric actuator 13 overlapping with the pressure chamber 32 is bent to be convex toward the side opposite to the pressure chamber 32.

In a case that the difference (D2−D1) between the displacement amount D1 and the displacement amount D2 is less than 200 nm and that the part of the piezoelectric actuator 13 overlapping with the pressure chamber 32 is bent to be convex toward the side opposite to the pressure chamber 32, the thickness of the liquid repellent layer 30 may be 10 nm or more.

In the above embodiment, the difference (D2−D1) between the displacement amount D1 and the displacement amount D2 is less than 200 nm and the part of the piezoelectric actuator 13 overlapping with the pressure chamber 32 is bent to be convex toward the side opposite to the pressure chamber 32 both in the ink-jet head 3 and the ink-jet head 203. The present teaching, however, is not limited to this.

The difference (D2−D1) between the displacement amount D1 and the displacement amount D2 may be 200 nm or more both in the ink-jet head 3 and the ink-jet head 203, provided that the part of the piezoelectric actuator 13 overlapping with the pressure chamber 32 is bent to be convex toward the side opposite to the pressure chamber 32.

Alternatively, in a case that the difference (D2−D1) between the displacement amount D1 and the displacement amount D2 is less than 200 nm, the part of the piezoelectric actuator 13 overlapping with the pressure chamber 32 may be bent to be convex toward the side opposite to the pressure chamber 32 in the ink-jet head 203 and the part of the piezoelectric actuator 13 overlapping with the pressure chamber 32 may be bent to be convex toward the pressure chamber 32 in the ink-jet head 3.

In the above embodiment, each pressure chamber 32 is formed in the silicon wafer 100 after the formation of the liquid repellent layer 30. The present teaching, however, is not limited to this configuration. The liquid repellent layer 30 may be formed after each pressure chamber 32 is formed in the silicon wafer 100. In this case, however, the liquid repellent layer 30 is formed on the bent surface as described above.

In the above embodiment, the liquid repellent layer 30 is formed by the deposition. The present teaching, however, is not limited to this configuration. The liquid repellent layer 30 may be formed by other methods such as the film formation method, provided that the thickness of the liquid repellent layer 30 is thin.

In the above embodiment, the channel formation substrate 11 is cut out from the silicon wafer 100 after the formation of the liquid repellent layer 30. The present teaching, however, is not limited to this configuration. The liquid repellent layer 30 may be formed after the channel formation substrate 11 is cut out from the silicon wafer 100.

In the above embodiment, the liquid repellent layer 30 is disposed only at the parts, of the upper surface of the surface protective layer 29, to which the protective member 14 is not bonded. The present teaching, however, is not limited to this. For example, in a case that the liquid repellent layer 30 is made of material which allows the adhesive 39 to be remained on the liquid repellent layer 30, the liquid repellent layer 30 may extend over the entire upper surface of the surface protective layer 29.

The liquid repellent layer 30 can prevent the moisture from reaching the piezoelectric layers 24 and the individual electrodes 25 provided that the liquid repellent layer 30 is disposed at least at parts overlapping with the piezoelectric layers 24 and the individual electrodes 25.

In the above embodiment, the protective member 14 including the recesses 41, the throttle channels 42, the ink storage chamber 43, and the like, is disposed on the upper surface of the piezoelectric actuator 13. The present teaching, however, is not limited to this.

<Second Modified Embodiment>

Figure 14:
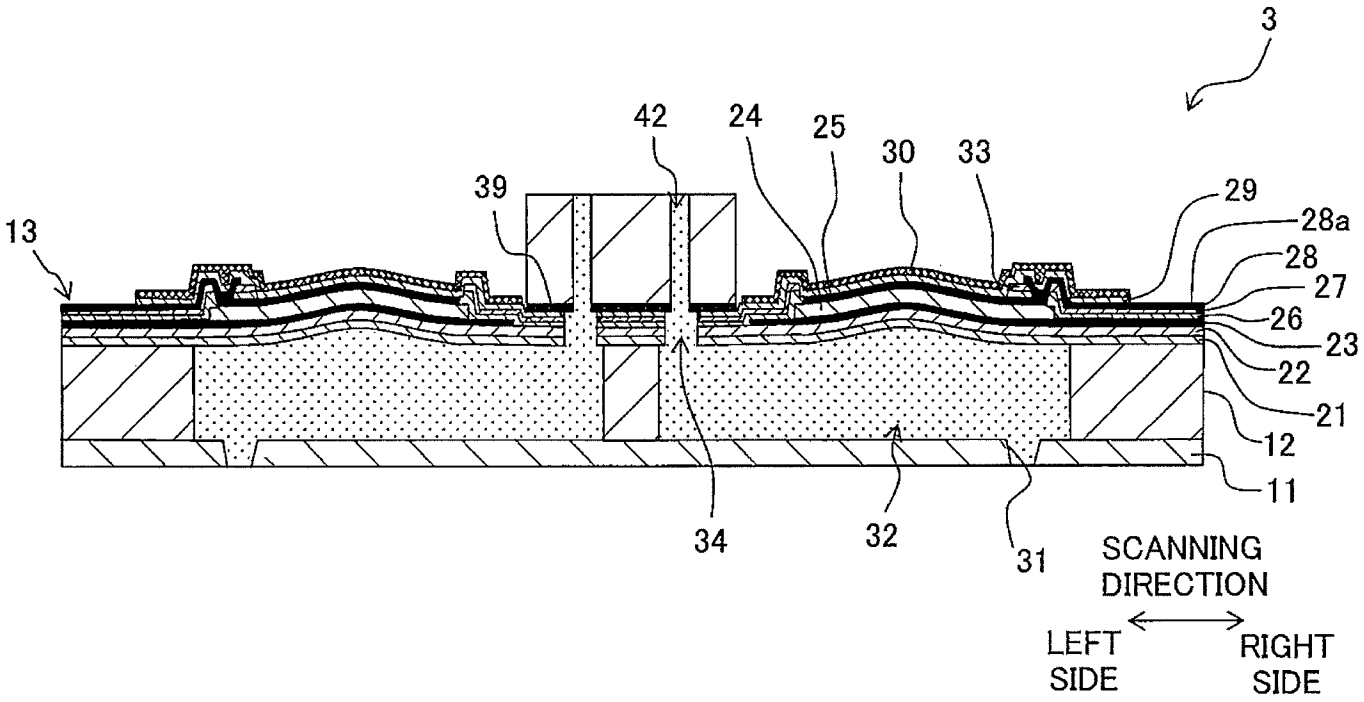
FIG. 14 is a diagram of a second modified embodiment which corresponds to FIG. 3.

As depicted in FIG. 14, the protective member 14 (see FIG. 2) is not disposed on the upper surface of the piezoelectric actuator 13 in a second modified embodiment. Instead of the protective member 14, there is disposed a throttle channel forming member 60 in which the throttle channels 42 which are the same as those of the above embodiment are formed.

In this case, although the part of the piezoelectric actuator 13 overlapping with the piezoelectric layer 24 is exposed, the liquid repellent layer 30 can prevent moisture from reaching the common electrode 23, the piezoelectric layer 24, and the individual electrode 25.

In the second modified embodiment, there is disposed, above the throttle channel forming member 60, a member for supplying ink to the throttle channels such as a member for forming a space in which the ink is stored.

In the above embodiment, the explanation has been made about the case in which the ink-jet head 3 is obtained by adding the liquid repellent layer 30 to the ink-jet head having the structure like the ink-jet head 203. The present teaching, however, is not limited to this configuration. The present teaching is applicable to a case in which the liquid repellent layer is added to an ink-jet head having a structure different from the ink-jet head 203. Here, the ink-jet head may originally include the liquid repellent layer. For example, the present teaching is applicable to a case in which another liquid repellent layer is added to an ink-jet head which includes the liquid repellent layer having a small contact angle in order to improve the liquid repellent property. The present teaching is particularly effective for the case as follows. That is, the repellent layer is added in a piezoelectric actuator in which the force in the tensile direction is generated on the upper side of a neutral plane of the piezoelectric actuator in a state that no liquid repellent layer is formed.

In the above description, the explanation has been made about the case in which the present teaching is applied to the ink-jet head which discharges the ink from the nozzles. The present teaching, however, is not limited to this configuration.

In addition to the ink-jet head, the present teaching is applicable to a liquid discharge apparatus which discharges liquid other than the ink.

What is claimed is:

1. A liquid discharge apparatus configured to discharge liquid, the apparatus comprising:

a channel formation substrate including a pressure chamber communicating with nozzle;

a piezoelectric actuator including:

an ink separation layer disposed on the channel formation substrate to cover the pressure chamber therewith;

a piezoelectric layer disposed on a surface, of the ink separation layer, on a side opposite to the channel formation substrate to overlap with the pressure chamber;

a first electrode sandwiched between the ink separation layer and the piezoelectric layer to overlap with the pressure chamber; and a second electrode disposed on a surface of each of the piezoelectric layer, on a side opposite to the ink separation layer to overlap with the pressure chamber;

a liquid repellent layer which is located on a top layer of the piezoelectric actuator and which is made of organic material to have a thickness of less than 10 nm; and wherein a part, of the liquid repellent layer and the piezoelectric actuator, overlapping with the pressure chamber is bent to be convex toward the side opposite to the pressure chamber.

2. The liquid discharge apparatus according to claim 1;

wherein a contact angle of the liquid repellent layer with respect to the liquid is 140 degrees or more.

3. The liquid discharge apparatus according to claim 2;

wherein the liquid repellent layer is made of a silane compound.

4. A liquid discharge apparatus configured to discharge liquid, the apparatus comprising:

a channel formation substrate including pressure chambers communicating with nozzles;

a piezoelectric actuator being configured to apply pressure to the liquid in the pressure chambers, the piezoelectric actuator including:

an ink separation layer disposed on the channel formation substrate to cover the pressure chambers therewith;

piezoelectric layers disposed on a surface, of the ink separation layer, on a side opposite to the channel formation substrate to overlap with the pressure chambers;

a first electrode sandwiched between the ink separation layer and the piezoelectric layers to overlap with the pressure chambers; and second electrodes disposed on a surface of each of the piezoelectric layers, on a side opposite to the ink separation layer to overlap with the pressure chambers;

a liquid repellent layer which covers the piezoelectric layers and the second electrodes from the side opposite to the ink separation layer;

wherein parts, of the piezoelectric actuator, overlapping with the pressure chambers are bent to be convex toward a side opposite to the pressure chambers;

a thickness of each of the piezoelectric layers is 1 μm or more; and the liquid repellent layer is made of organic material to have a thickness of less than 10 nm.

5. The liquid discharge apparatus according to claim 4;

wherein a contact angle of the liquid repellent layer with respect to the liquid is 140 degrees or more.

6. The liquid discharge apparatus according to claim 5;

wherein the liquid repellent layer is made of a silane compound.

* * * * *